US005204488A

United States Patent [19]

Cimolino et al.

[11] Patent Number: 5,204,488

[45] Date of Patent: Apr. 20, 1993

[54] PROCESS AND APPARATUS FOR PRIMING AMMUNITION CASINGS THAT ARE FIRED BY PERCUSSION ON AN ANNULAR FLANGE OF THE CASINGS

[75] Inventors: Gratien Cimolino, Othis; Michel Pitavy, Vaucresson; Roger Dolbet, Clermont, all of France

[73] Assignee: N.C.S. Pyrotechnie et Technologies, Survilliers, France

[21] Appl. No.: 838,161

[22] Filed: Feb. 20, 1992

[30] Foreign Application Priority Data

Feb. 20, 1991 [FR] France ..... 91 02011

[51] Int. Cl.[5] ..... F42B 33/24

[52] U.S. Cl. ..... 86/32

[58] Field of Search ..... 86/31-33; 102/471

[56] References Cited

U.S. PATENT DOCUMENTS

| | | | |
|---|---|---|---|
| 2,031,850 | 2/1936 | Peterson | 86/27 |
| 2,357,863 | 9/1944 | Young et al. | 86/33 |
| 2,981,137 | 4/1961 | Sahlin | 86/32 |
| 3,257,892 | 6/1966 | Hubbard | 86/32 |
| 3,893,492 | 7/1975 | Nohren | 86/31 X |
| 4,640,724 | 2/1987 | Carter | 86/32 X |

FOREIGN PATENT DOCUMENTS

| | | |
|---|---|---|
| 1578099 | 4/1971 | Fed. Rep. of Germany . |
| 2570816 | 3/1986 | France . |

*Primary Examiner*—Charles T. Jordan

*Attorney, Agent, or Firm*—Young & Thompson

[57] ABSTRACT

A process and apparatus for priming ammunition casings (1) of the type having a bottom (2) connected to a cylindrical lateral wall (3) by an annular flange (4) defining within the casing an annular throat (5) adapted to receive a pyrotechnic priming composition (6). The composition (6) is deposited on the bottom of the casing, and then is introduced into the throat (5) by subjecting the composition (6) deposited on the bottom (2) of the casing to a progressive compression in an oblique direction relative to the axis (X-X') of the casing (1) and directed toward the throat (5), by means of a surface (8) which is caused to turn about the axis (X-X'). This is done with a rotating core (7) that has at its lower end a truncated conical surface that is eccentric to the axis (X-X') of the core (7).

16 Claims, 3 Drawing Sheets

Figure 1:
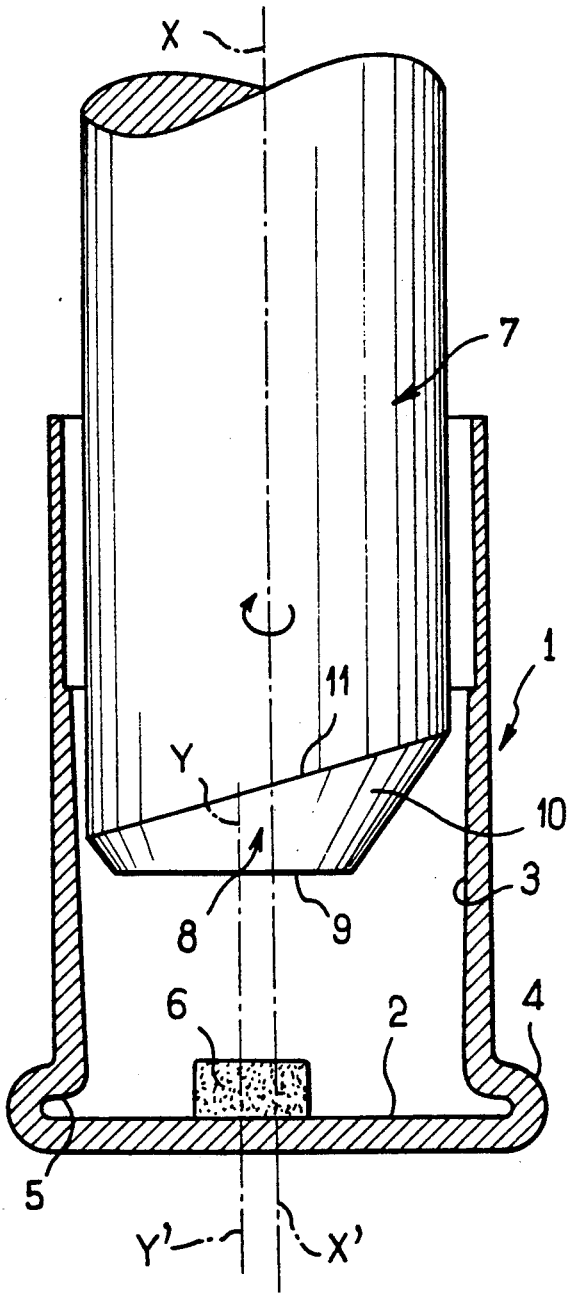

PROCESS AND APPARATUS FOR PRIMING AMMUNITION CASINGS THAT ARE FIRED BY PERCUSSION ON AN ANNULAR FLANGE OF THE CASINGS

The present invention relates to a process for priming the casings of small ammunition or sealed charges for annular percussion, these casings comprising a bottom connected to their side wall by an annular flange defining within the casing an annular throat adapted to receive the pyrotechnic primer composition.

Such ammunition or sealed charges are fired by percussion applied to the annular flange of the casing.

At present, the introduction of the pyrotechnic composition into the flange is effected by a process, called "turbinage", consisting in projecting, by a core driven at a high speed of rotation (of the order of 5,000 rpm), a small cake of a pyrotechnic composition previously deposited on the bottom of the casing. The cylindrical core has teeth on its end face; in a suitable machine, this continuously rotating core descends within the positioned casing and disperses the cake of pyrotechnic material by lateral centrifugal projection, thereby introducing the material into the annular flange of the casing.

Most of the manufacturers of small ammunition and of sealed charges use machines employing this process in a unitary industrial operation mechanically automated to obtain high speeds of production. The annularly primed casing is then filled with a particular pyrotechnic powder to obtain a product which is then transformed into a cartridge either in the form of a sealed charge, or in the form of small ammunition with the emplacement of a small bullet seated on the forward end of the casing.

Another process, called "compression" used for priming of the casings, consists in crushing in the bottom of the casing the small cake of pyrotechnic primer composition, with a cylindrical punch having a hemispherical end, mounted on a press providing sufficient compression to cause the material to flow and fill the annular flange of the casing.

These two priming processes constitute at present the state of the art of priming material for the casing, without chemical transformation of the material in the flanges. These processes have certain drawbacks.

These are that they both are processes that are relatively rough; the pyrotechnic material, moistened to reduce as much as possible inadvertent firing, is vigorously manipulated, by projection or by powerful crushing, which can give rise to possible flaming, and hence destruction of the product.

Moreover, these processes ordinarily do not prevent a certain rising of the material between the core and the casing, which makes the product pyrotechnically fragile during subsequent fabrication.

The primary pyrotechnic priming material is generally a mixture comprising essentially a primary pyrotechnic composition, for example lead trinitroresorcinate, and glass microballs or powder; this latter material undergoes relatively rapid wear from the cores during the turbinage process, by virtue of the very rapid rotation necessary. Moreover, the turbinage process requires an especially specific composition of the pyrotechnic material used.

Finally, these processes do not permit correctly regulating the degree of compactness of the pyrotechnic material introduced into the flange of the casing, so as to obtain good regularity of operation.

The object of the present invention is to overcome the drawbacks of the two above processes, by providing a process for priming casings which avoids all risk of premature firing of the pyrotechnic composition, reduces the mechanical wear of the parts relative to the so-called "turbinage" process while ensuring better quality and better regularity of operation of the products obtained.

The invention thus provides a priming process for the casings of ammunition or sealed charges, these casings comprising a bottom connected to their side wall by an annular flange defining within the casing an annular throat adapted to receive the pyrotechnic priming composition, the process consisting in introducing the composition into said throat.

According to the invention, this process is characterized in that said composition is introduced into said throat, by subjecting the composition disposed on the bottom of the casing to a progressive compression in a direction that is oblique relative to the axis of the casing and directed toward the throat, this progressive oblique compression being obtained by a surface having no acute angle, which is caused to turn about said axis.

The process according to the invention thus combines a downward compressive effect, a radial propulsive effect toward the periphery of the bottom of the flange, and a sliding effect under pressure of the material at the entrance to the flange.

However, contrary to the cases of the known processes of "turbinage" and compression, these effects are progressive instead of being abrupt such that the risk of premature firing of the pyrotechnic composition is avoided.

Moreover, given that the compression is applied progressively and in an oblique direction toward the base, the pyrotechnic composition has less tendency to rise along the length of the lateral surface of the casing, which further decreases the risk of firing of this latter.

Still further, the progressivity of the applied compression involves less wear of the tool used for this purpose.

According to a preferred embodiment of the invention, the said surface is turned at a speed between 100 and 2000 rpm.

This speed of rotation is substantially less than in the case of the known "turbinage" process, such that the composition is subjected to less abrupt effects and the wear of the said surface is low.

Preferably, said surface is subjected to an axial force directed toward the bottom of the casing comprised between 20 and 100 Newtons. This force is low relative to that applied in the case of the known priming process by compression. As a result, the apparatus used to apply this force can be greatly reduced in size.

The invention also provides the apparatus for practicing the above process. This apparatus comprises a core having a diameter corresponding substantially to the internal diameter of the casing which is to be primed, means to introduce this core into the casing along the axis of the latter, and means to drive this core in rotation about said axis.

According to the invention, said core has at its end adjacent the bottom of the casing a surface free from sharp angles, eccentric relative to the axis of this core and having at the periphery of the region adapted to bear on the bottom of the casing a surface forming an acute angle relative to the bottom of the casing.

According to a preferred embodiment of the invention, the region adapted to bear on the bottom of the casing is substantially flat.

According to a preferred embodiment of the invention, the eccentric surface is a truncated conical surface whose axis is parallel to that of the core, the small base of this truncated conical surface corresponding to the region adapted to come to bear on the bottom of the casing.

This eccentric truncated conical surface has no sharp angle adapted to wear rapidly by abrasion; and moreover, its geometry permits simple mechanical and unencumbered construction.

Figure 2:
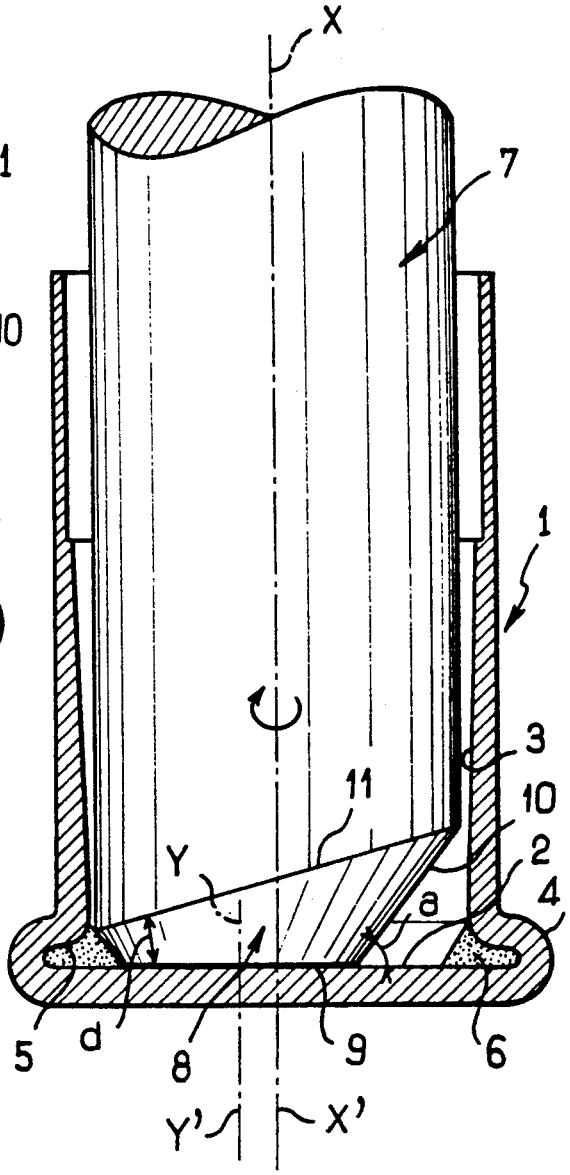
Figure 3:
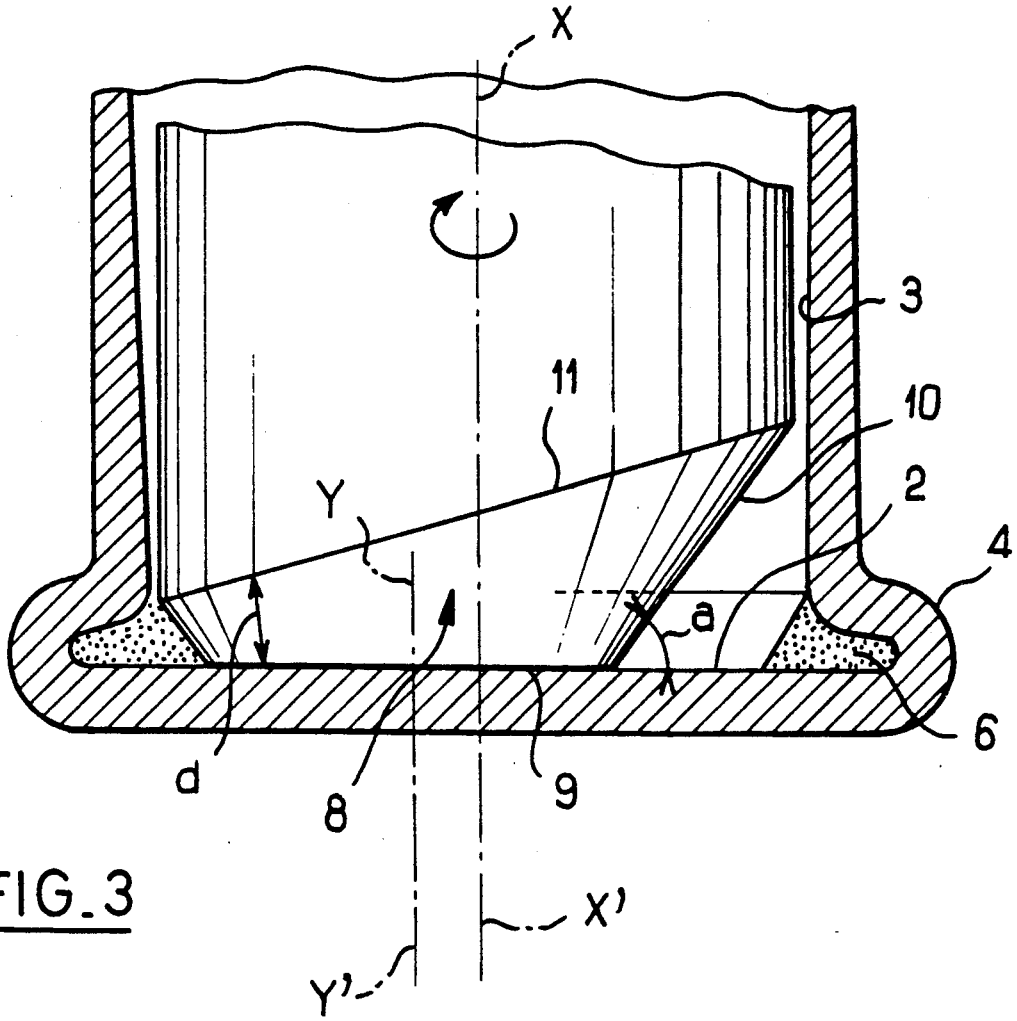
Figure 4:
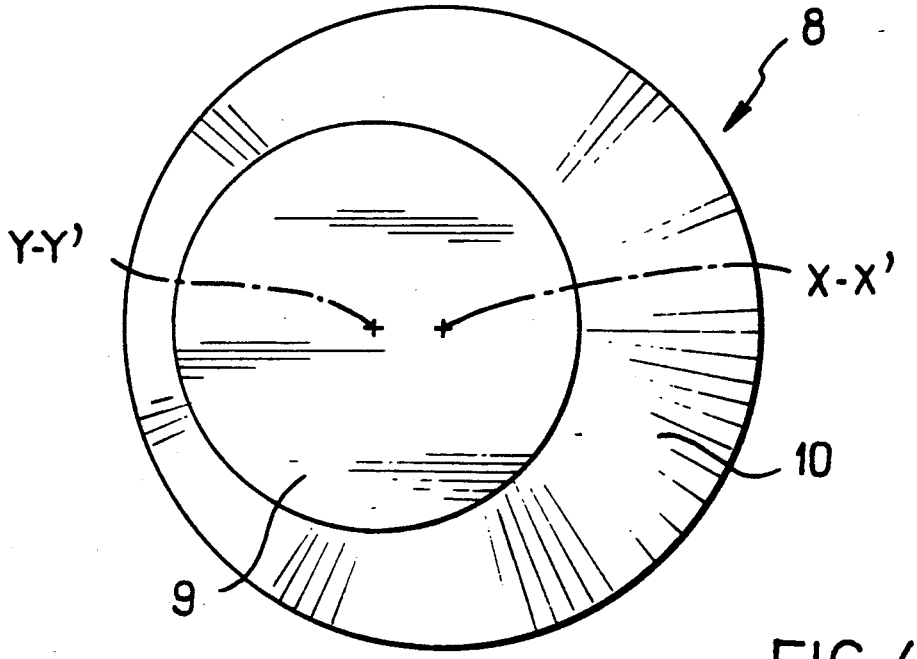
Figure 5:
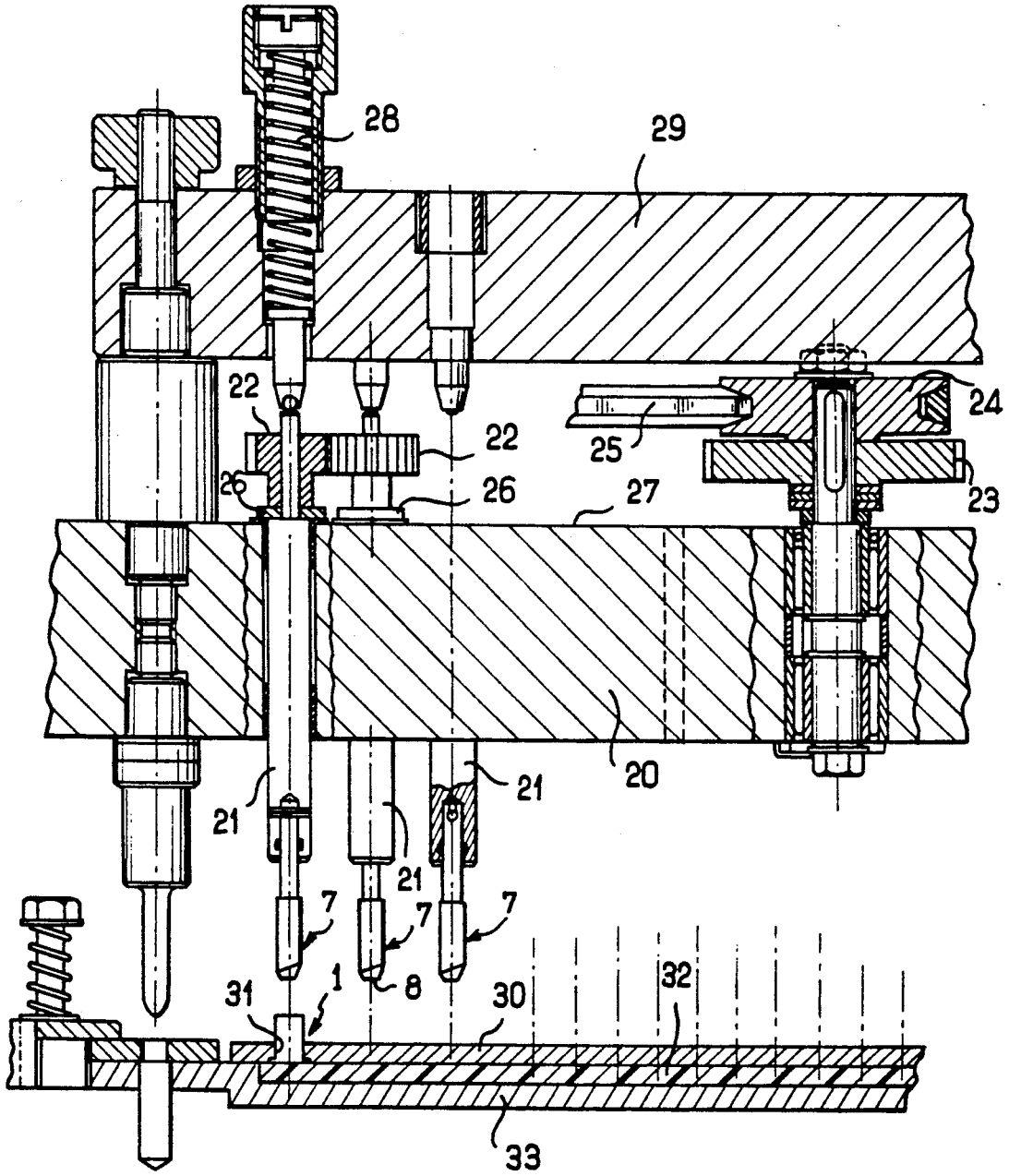

Other features and advantages of the invention will become apparent from the following description:

In the accompanying drawings, given by way of non-limiting example:

FIG. 1 is a cross sectional view on the axis of the casing showing a cake of pyrotechnic composition disposed in the bottom of the casing and the engagement of a core in this latter to apply this composition into the annular throat, FIG. 2 is a view similar to FIG. 1, showing the composition which has been applied into the annular throat by means of the core, FIG. 3 is a view on a larger scale of the lower portion of FIG. 2, FIG. 4 is a plan view of the end of the core, FIG. 5 is a fragmentary longitudinal cross sectional view of an apparatus for practicing the process according to the invention.

In FIGS. 1 and 2, there is shown a casing 1 of ammunition or a sealed charge, comprising a bottom 2 connected to the side wall 3 by an annular flange 4 defining within the casing an annular throat 5 adapted to receive the pyrotechnic primer composition.

The priming process consists in depositing, as shown in FIG. 1, at the bottom of the casing, a pyrotechnic composition in the form of a small cake 6, then introducing this composition into the annular throat 5.

According to the invention, the composition 6 is introduced into the annular throat 5 by means of a rotating core 7 which subjects the composition 6 deposited on the bottom 2 of the casing 1 to a progressive compression in an oblique direction D (see FIG. 3) relative to the axis of the casing 1.

This progressive compression in the oblique direction D is effected by means of a surface 8 which is eccentric relative to the axis X-X' of the casing 1 which is applied to the bottom 2 of the casing and which is caused to turn about the axis X-X' of the casing.

This eccentric surface 8 provides at the periphery of the region 9 which bears on the bottom 2 of the casing, a surface 10 forming an acute angle a relative to the bottom 2 of the casing 1.

The speed of rotation of the eccentric surface 8 can be comprised between 100 and 2000 rpm. Preferably, the speed is of the order of 1000 rpm.

The eccentric surface 8 is subjected to an axial force directed toward the bottom 2 comprised between 20 and 100 Newtons, which is a low value relative to that used in the known so-called "compression" process.

There will now be described in detail the apparatus for practicing the process according to the invention.

This apparatus comprises essentially a core 7 having a diameter corresponding substantially to the diameter of the casing 1 which is to be primed, means which will be described in detail with reference to FIG. 5 to introduce this core 7 into the casing 1 along the axis X-X' of this latter and means to drive this core 7 in rotation about said axis X-X'. This core 7 has at its end adjacent bottom 2 of the casing a surface 8 which is eccentric relative to the axis X-X' of this core and comprises at the periphery of a region 9 adapted to bear on the bottom 2 of the casing a surface 10 forming an acute angle a relative to the bottom 2 of the casing.

This region 9 which is to bear on the bottom 2 of the casing 1 is substantially flat. It could however be slightly convex.

In the example shown in FIGS. 1 to 3, the eccentric surface 8 is a truncated conical surface whose axis Y-Y' is parallel to the axis X-X' of the core 7. The small base 9 of this truncated conical surface 8 corresponds to the region which is to bear on the bottom 2 of the casing 1.

The side surface 10 of this truncated conical surface 8 forms an acute angle a comprised between 35° and 50° relative to the bottom 2 of the casing 1.

The intersection between the core 7 and the truncated conical surface 8 is a curve 11 located in a plane which is oblique relative to bottom 2 of the casing. The distance d between this bottom 2 and the said curve 11 varies progressively between a value substantially equal to the height of the annular throat 5 (see the left portion of FIG. 3) and a value comprised between three and five times this height (see the right-hand portion of FIG. 3).

There will now be explained the operation of the above apparatus.

In a first stage, the small cake 6 of pyrotechnic priming composition, which is compacted and moist, is introduced in known manner into the casing 1.

In a second stage, the core 7 is introduced axially into the casing 1, while being rotated. The casing 1 bears against a horizontal surface and is blocked against rotation with the aid of suitable means.

Surface 9 of core 7 bears against the cake 6 with a force of the order of 40 Newtons, which compresses it and spreads it out on the bottom 2 of the casing.

Due to the shape of the eccentric truncated conical surface 8, the composition 6 is subjected to a progressive compression whose direction D is oblique. This oblique compression presses the composition 6 into the annular throat 5.

After only a few turns of the core 7, the composition 6 fills completely the throat 5 in which it is uniformly compacted. The interior edge 6a of the composition 6 has a truncated conical surface complementary to that which is generated by the portion of the truncated surface 8 of the core which is the lowest relative to the bottom 2 of the casing.

The best results are obtained when the volume $V_1$ of the priming composition 6 introduced into the casing 1, the volume $V_2$ of the annular throat 5 limited internally of the casing, the volume $V_3$ generated by the smallest oblique segment of the truncated conical surface 8 and the volume $V_4$ comprised between the truncated conical surface 8 of the core, the cylindrical side wall 3 of the casing and the bottom 2 of the casing, satisfy the following relationships:

$$V_2+V_3 \leqq V_1, \text{ and } V_4 > V_1.$$

When these relationships are satisfied, there is obtained a complete and regular and highly compact filling of the annular throat 5, favorable to good shock resistance of the composition, as well as the use if desired of primary pyrotechnic materials of non-toxic organic nature requiring relatively high compactness.

Moreover, the lower shape of the core has no sharp angle adapted to give rise to retention of material; this favorable arrangement, as well as the absence of the rising of material in the casing, leads to almost total absence of risk of displacement of material, from one casing into another casing, during an automated industrial process.

The fairly low speed of rotation limits the wear of the core in frictional engagement with the pyrotechnic material loaded with glass powder; moreover, the shape of the end of the core is such that wear of the assembly of the portions in contact with the material substantially maintains the general shape of the core, without reducing its effectiveness. Such a core, according to the invention, thus has a longer life, therefore a lower cost of use.

There is shown in FIG. 5 an apparatus permitting the simultaneous priming in automatic fashion of a large number of casings 1.

This apparatus comprises a cross member 20 which supports a series of vertical parallel spindles 21 each bearing at its lower end a core 7. All these spindles 21 are driven in rotation by toothed wheels 22 engaging each other and connected to a drive system comprising a toothed wheel 23 fixed to a pulley 24 itself connected to a motor (not shown) by means of a belt 25.

The spindles 21 comprise at their upper portion a small collar bearing on the upper surface 27 of the cross member 20 thanks to the force exerted by a spring 28 mounted in the cross member 29 extending above the cross member 20. The assembly is connected to a vertically reciprocable system (not shown) which displaces the cores 7 along their vertical axes between an upper position (shown in FIG. 5) and a lower position. In the lower position, the cores 7 are engaged in the casings 1 located exactly in line with these cores 7.

In this lower position, the cores 7 compress the pyrotechnic composition against the bottoms of the casings 1. Because of this bearing on the bottom of the casings, the cross member 20, when descending, causes the compression of the springs 28 by the cores 7 to a value for example equal to 40 Newtons.

It will be seen in FIG. 5 that each casing 1 is disposed in a hole 31 provided in a plate 30 and in which the casing 1 is retained by its annular flange 4.

Below the plate 30 extends a sheet 32 of elastomer which is sandwiched between this plate 30 and a second plate 33.

The bottom of the casings 1 is in contact with the sheet of elastomer.

When the cores 7 bear against the bottoms of the casings 1, the sheet of elastomer 32 is compressed such that the bottom of the casings have with the elastomeric surface a coefficient of friction such that the casings 1 will not be driven in rotation by the cores 7.

Of course, the invention is not limited to the exemplary embodiments which have been described, and numerous modifications could be imparted to these without departing from the scope of the invention.

What is claimed is:

1. In a process for priming ammunition casings (1) comprising a bottom (2) connected to a cylindrical side wall (3) by an annular flange (4) defining within the casing an annular throat (5) adapted to receive a pyrotechnic priming composition (6), the process comprising depositing on the bottom of the casing said composition (6), then introducing said composition (6) into said throat (5); the improvement comprising introducing said composition into said throat (5) by subjecting the composition (6) disposed on the bottom (2) of the casing to a progressive compression in an oblique direction (D) relative to the axis (X-X') of the casing and directed toward the throat (5), this progressive oblique compression being created by means of a surface (8), without a sharp angle and which is eccentric relative to said axis (X-X') of the casing, which is caused to turn about said axis (X-X').

2. Priming process according to claim 1, wherein said progressive compression along an oblique direction is effected by means of said surface (8) which is applied to the bottom (2) of the casing and which is caused to turn about the axis (X-X') of the casing, this eccentric surface (8) having at the periphery of the region (9) which bears on the bottom (2) of the casing, a surface portion (10) forming an acute angle (a) relative to the bottom of the casing.

3. Priming process according to claim 1, wherein said eccentric surface (8) is caused to turn at a speed comprised between 100 and 2000 rpm.

4. Priming process according to claim 1, wherein said surface is subjected to an axial force directed toward the bottom (2) of the casing comprised between 20 and 100 Newtons.

5. Priming process according to claim 1, wherein said surface (8) is truncated conical and has an axis that is parallel to but spaced from said axis (X-X') of the casing.

6. Priming process according to claim 2, wherein said region (9) which bears on the bottom (2) of the casing is flat and circular about an axis (Y-Y') spaced from said axis (X-X') of the casing.

7. In apparatus for priming ammunition casings (1) comprising a bottom (2) connected to a cylindrical side wall (3) by an annular flange (4) defining within the casing (1) an annular throat (5) adapted to receive a pyrotechnic priming composition (6), said apparatus comprising a core (7) having a diameter corresponding substantially to the internal diameter of the casing (1) which is to be primed, means to introduce this core (7) into the casing along the axis (X-X') of the latter and means to drive this core (7) in rotation about said axis; the improvement wherein said core (7) has an end adjacent the bottom (2) of the casing (1) and on said end a surface (8) without a sharp angle and which is eccentric relative to the axis (X-X') of said core (7) and has at the periphery of a region (9) adapted to bear against the bottom (2) of the casing a surface (10) forming an acute angle (a) relative to the bottom (2) of the casing.

8. Apparatus according to claim 7, wherein said region (9) adapted to bear against the bottom (2) of the casing is substantially flat.

9. Apparatus according to claim 7, wherein said eccentric surface (8) is a truncated conical surface whose axis (Y-Y') is parallel to and spaced from that of the core (7), the small base of this truncated conical surface (8) corresponding to the region (9) adapted to bear against the bottom (2) of the casing.

10. Apparatus according to claim 9, wherein the lateral surface (10) of said truncated conical surface (8) forms an angle comprised between 35° and 50° relative to the bottom (2) of the casing.

11. Apparatus according to claim 9, wherein the intersection between the core (7) and the truncated conical surface (8) is a curve (11) disposed in a plane which is oblique relative to the bottom (2) of the casing, the distance d between this bottom and the said curve (11) varying progressively between a value substantially equal to the height of the annular throat (5) and a value comprised between three times and five times this height.

12. Apparatus according to claim 9, wherein the volume ($V_1$) of the priming composition (6) introduced into the casing, the volume ($V_2$) of the annular throat (5) limited internally to the cylinder defined by the internal surface of the casing, the volume ($V_3$) generated by the smallest oblique segment of the truncated conical surface (8) and the volume ($V_4$) defined between the truncated conical surface (8) of the core (7), the lateral cylindrical wall (3) of the casing and the bottom (2) of the casing, satisfy the following relations:

$$V_2+V_3 \leqq V_1, \text{ and } V_4 > V_1.$$

13. Apparatus according to claim 7, which further comprises a series of parallel cores (7), means (20, 21) to displace said series of cores (7) simultaneously relative to a series of casings (1) disposed in alignment with the axes of said cores, between a position disengaged from the casings (1) and a position engaged in these latter and bearing against the bottom (2) of these casings, each core (7) sliding against the action of a return spring (28) when the core (7) bears on the composition on the bottom (2) of the casing, said spring (28) determining a predetermined pressure against the bottom (2) of the casing, and means (22, 23, 24, 25) to drive in rotation the assembly of cores (7).

14. Apparatus according to claim 13, further comprising a plate (30) having holes (31) serving for the reception of the casings (1), there being at the bottom of the holes (31) a material (32) coacting with the bottom of the casings (1) to form a friction surface.

15. Apparatus according to claim 14, wherein said friction material is a sheet of elastomer (32) extending below the holes (31).

16. Apparatus according to claim 7, wherein said region (9) which bears on the bottom (2) of the casing is flat and circular about an axis (Y–Y') spaced from said axis (X–X') of the casing.

* * * * *